US007111678B2

(12) United States Patent
McElroy et al.

(10) Patent No.: US 7,111,678 B2
(45) Date of Patent: Sep. 26, 2006

(54) FIELD ADJUSTABLE IMPACT JAR

(75) Inventors: Fay McElroy, Houma, LA (US); James Burnthrone, Jr., Houma, LA (US); Lonnie Guidry, Lockport, LA (US)

(73) Assignee: Impact Selector, Inc., Rockwell, TX (US)

( * ) Notice: Subject to any disclaimer, the term of this patent is extended or adjusted under 35 U.S.C. 154(b) by 182 days.

(21) Appl. No.: 10/696,823

(22) Filed: Oct. 30, 2003

(65) Prior Publication Data

US 2005/0092494 A1 May 5, 2005

(51) Int. Cl.
*E21B 31/107* (2006.01)
*E21B 4/08* (2006.01)

(52) U.S. Cl. ..... 166/178; 175/299; 175/303; 173/112; 173/120

(58) Field of Classification Search ..... 166/301, 166/381, 98, 178; 175/293, 299, 300, 302, 175/303, 304, 305, 306; 173/39, 42, 81, 173/90, 112, 115, 120, 202
See application file for complete search history.

(56) References Cited

U.S. PATENT DOCUMENTS

| | | | | | |
|---|---|---|---|---|---|
| 1,954,513 | A | * | 4/1934 | Beck | 175/303 |
| 2,144,869 | A | * | 1/1939 | Boulter | 175/299 |
| 2,166,299 | A | * | 7/1939 | Kennedy et al. | 175/299 |
| 2,557,238 | A | * | 6/1951 | Shaffer | 175/303 |
| 2,634,102 | A | * | 4/1953 | Howard | 175/296 |
| 2,903,241 | A | * | 9/1959 | Brown | 175/303 |
| 3,208,541 | A | * | 9/1965 | Lawrence | 175/299 |
| 3,360,060 | A | * | 12/1967 | Kinley et al. | 175/299 |
| 3,685,598 | A | * | 8/1972 | Nutter | 175/302 |
| 4,333,542 | A | * | 6/1982 | Taylor | 175/299 |
| 4,463,815 | A | | 8/1984 | Jurgens et al. | |
| 4,665,998 | A | | 5/1987 | Burton | |
| 4,919,219 | A | * | 4/1990 | Taylor | 175/299 |
| 5,022,473 | A | * | 6/1991 | Taylor | 175/299 |
| 5,103,903 | A | | 4/1992 | Marks, II | |
| 5,139,086 | A | | 8/1992 | Griffith, Jr. | |
| 5,156,211 | A | | 10/1992 | Wyatt | |
| 5,170,843 | A | | 12/1992 | Taylor | |
| 5,330,018 | A | | 7/1994 | Griffith | |
| 5,844,157 | A | | 12/1998 | Kasha | |
| 5,875,842 | A | | 3/1999 | Wyatt | |
| 6,290,004 | B1 | | 9/2001 | Evans | |
| 6,896,060 | B1 | * | 5/2005 | Tillett, Jr. | 166/301 |

* cited by examiner

*Primary Examiner*—Jennifer H. Gay
(74) *Attorney, Agent, or Firm*—Haynes & Boone LLP; Dave R. Hofman

(57) ABSTRACT

An impact jar including a biasable member, an impactor and an impactee slidably coupled to the impactor. The impactor includes a first down-hole tool connector. The impactee includes a second down-hole tool connector distal from the first down-hole tool connector and a plurality of flexible coupling fingers. The biasable member is detachably engaged by the plurality of flexible coupling fingers in a pre-impact position and is configured to disengage the plurality of flexible coupling fingers in response to a tensile force applied across the first and second down-hole tool connectors reaching a predetermined quantity. The impactor and the impactee are configured to impact in response to the disengagement of the biasable member and the plurality of flexible coupling fingers. In one embodiment, the impact jar may be employed in either of e-line and slickline applications.

37 Claims, 9 Drawing Sheets

200

110a
110a
130
205
160
110a
210
160
110a
215
220
225
230
110a

200

110a
110a
130a
130a
130a
235
240
245
130a
110a
245
280
250
255
260
120

FIELD ADJUSTABLE IMPACT JAR

BACKGROUND

The present disclosure relates generally to wellbore equipment and, more specifically, to a field adjustable impact jar.

In oil and gas well operations, a work string or portions thereof may become lodged within a wellbore to such a degree that it cannot be readily dislodged. Consequently, it is frequently necessary to inflict axial blows to lodged or securely installed equipment to attempt its removal.

A jar is one type of device often employed in wellbore operations to enable the delivery of such axial blows. Generally, a jar includes anvil and hammer portions configured such that sliding the hammer and anvil together at high velocity imparts an impact force or impulse (hereafter collectively referred to as either an impact force, an impulse or an impulse force) to the lodged equipment, hopefully sufficient to dislodge the lodged equipment. A triggering mechanism is typically employed to retard or delay the motion of the anvil and hammer relative to each other until the working string experiences a predetermined amount of axial tensile strain. The axial tensile strain is caused by a tensile load applied at the well surface by a wireline or another portion of a working string. This tensile force is resisted by the triggering mechanism of the jar long enough to allow the working string to stretch and store potential energy. When the jar triggers, the stored potential energy is converted to kinetic energy causing a high impulse impact between the anvil and hammer portions.

Operation of such impact jars may be hydraulic, mechanical or a combination thereof. A mechanical jar usually includes a friction sleeve coupled to the mandrel to resist movement of the mandrel until the tensile load exceeds a predetermined amount. A hydraulic jar has an orifice within it and is filled with a liquid. It is operated by building tension on the working string or tool string and waiting for sufficient fluid to bypass internally to allow the jar to reach its internal release position. The jar then rapidly opens such that stored energy is imparted to the lodged equipment.

Mechanical jars and hydraulic jars each have advantages over the other. Mechanical jars must be adjusted on the surface to the anticipated release tension prior to being run in the hole. If these jars are set to a release tension which cannot be attained upon down-hole engagement, or if the tension proves to be too low to be effective, the work string must be disengaged, pulled out of the hole, and readjusted.

Hydraulic jars also offer a wide variety of possible triggering loads. The range of possible triggering loads for a hydraulic jar is a function of the amount of axial strain applied by stretching the working string, and is limited only by the structural limits of the jar and the seals therein. However, hydraulic jars are also relatively expensive and not very dependable, as they have a tendency to become contaminated by wellbore environments due to the high internal temperatures and pressure differentials inherent to their operation. Most hydraulic jars are also relatively long, in some instances having a length exceeding 25 feet.

Working strings suspend tool strings in the wellbore via e-lines, slicklines, coiled tubing, snubbing or combinations thereof. Generally, e-lines employ a multi-functional wire to suspend a tool in a specific location in a well and to transmit power and/or data signals between the wellbore and the well surface. Conversely, slicklines employ a simple or braided wire to suspend a tool in its selected location, and are designed to require no electrical power from the surface to perform their designed function. Coiled tubing generally comprises continuous pipe or tubing stored on a tubing reel, whereas snubbing generally comprises jointed pipe or tubing assembled at the surface before insertion. Some operations may include both e-line and slickline applications, or other combinations, thereby necessitating pulling the working string from the wellbore to interchange tools before running the working string back into the wellbore. Obviously, this change is deleterious to the efficiency and productivity of wellbore operations.

Accordingly, what is needed in the art is an impact jar that addresses the above-discussed issues.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
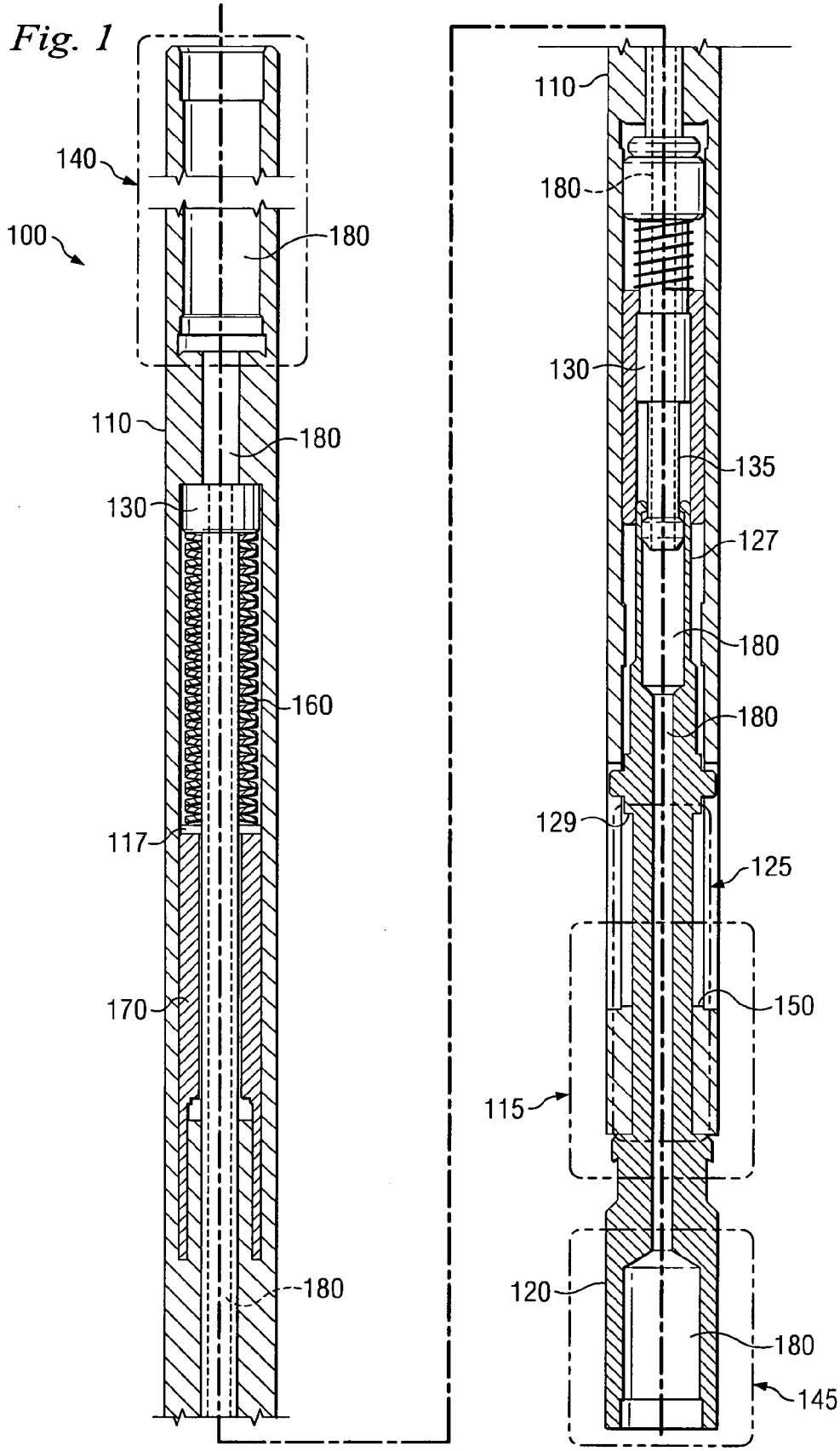
FIG. 1 illustrates a sectional view of one embodiment of an impact jar constructed according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over, on or coupled to a second feature in the description that follows may include embodiments in which the first and second features are in direct contact, and may also include embodiments in which additional features interpose the first and second features, such that the first and second features may not be in direct contact.

Referring to FIG. 1, illustrated is a sectional view of one embodiment of an impact jar 100 constructed according to aspects of the present disclosure. The impact jar 100 includes an impactor 110, an impactee 120 and a biasable member 130, each of which may comprise nitrided steel. The impactor 110 may substantially house the remaining components of the impact jar 100 and, as such, may be considered and referred to as a housing. The impactor 110 includes a first down-hole tool connector 140. In one embodiment, the first down-hole tool connector 140 may comprise a standard threaded coupling, such as those having tapered NPT threads. However, the first down-hole tool connector 140 may also be or include a standard box or pinned coupling. In general, the first down-hole tool connector 140 may be configured such that the impactor 110 may be rigidly coupled to a portion of a working string assembly. Moreover, the first down-hole tool connector 140 may allow rotation of the impactor 110 relative to the working string, or may prevent such rotation. The first down-hole tool connector 140 may be integral to the impactor 110, or may be a discrete member welded or otherwise coupled to the impactor 110.

The impactor 110 also includes an impact stop 150. In one embodiment, the impact stop 150 may be or include a shoulder integral to or otherwise extending from an interior surface of the impactor 110. The impact stop 150 may also be a discrete annulus or otherwise shaped member welded or otherwise coupled to the impactor 110.

The impactee 120 is slidably coupled to the impactor 110. For example, a portion of the impactee 120 may have an outer diameter or other profile configured to be received by a corresponding inner diameter or other profile of the impactor 110. In the illustrated embodiment, the impactee 120 includes a cylindrical body 125 configured to slide within a barrel portion 115 of the impactor 110. The impact jar 100 may also include set screws or pins coupled to the impactee 120 after the impactee 120 has been assembled in the impactor 110, such that the set screws or pins may prevent the impactee 120 from sliding entirely out of the impactor 110. Accordingly, the impactee 120 may be coupled to the impactor 110 while also able to slide within the impactor 110.

The impactee 120 also includes a second down-hole tool connector 145. The second down-hole tool connector 145 may be substantially similar to the first down-hole tool connector 140 in composition, manufacture and function. For example, the second down-hole tool connector 145 may be configured to be rigidly coupled to a portion of a down-hole working string or tool string that may allow or prevent rotation of the impactee 120 relative to the string. In general, the second down-hole tool connector 145 is configured to impart an impulse on at least a lower portion of the working or tool string, possibly in an attempt to dislodge the string in the event the string becomes lodged in a wellbore. Such an impulse may be the result of an impact of the impactee 120 against the impact stop 150 of the impactor 110. Accordingly, the impactee 120 may include a shoulder or other stop 129 integral to the impactee 120 and providing a rigid surface for impacting the impact stop 150. The impactee stop 129 may also be a discrete member welded or otherwise coupled to the impactee 120.

The biasable member 130 may be substantially contained within the impactor 110, and may be assembled in the impact jar 100 in a manner permitting axial translation of the biasable member 130 within the impactor 110. Moreover, the biasable member 130 may be biased to a neutral position. For example, as in the illustrated embodiment, the biasable member 130 may include one or more springs 160 that may encourage the biasable member 130 into a neutral position. The spring 160 may comprise one or more Bellville washers or other types of compression, tension and/or torsion springs. The spring 160 may also be integral to the biasable member 130, or may be discrete members assembled to the biasable member 130 or other component of the impact jar 100. The impactor 110 may also include a compression stop 117 fixing an end of the spring 160 relative to the impactor 110. The compression stop 117 may be a fixed washer or other component, or may be a protrusion extending from an inner surface of the impactor 110.

The biasable member 130 is detachably engaged to the impactee 120. For example, in the illustrated embodiment, the biasable member 130 includes a coupling member 135 extending from an end proximate the impactee 120, and the impactee 120 includes a plurality of coupling fingers 127 configured to detachably engage the coupling member 135. Thus, the impactee 120 is configured to grasp the biasable member 130. Of course, in other embodiments, the biasable member 130 may include grasping elements configured to detachably engage a coupling member extending from the impactee 120. Moreover, while either of the biasable member 130 and the impactee 120 may comprise the grasping element and either of the biasable member 130 and the impactee 120 may comprise the coupling member engaged by the grasping element, the grasping element need not grasp the outside of the coupling member. For example, in FIG. 1, the coupling fingers 127 of the impactee 120 are grasping elements configured to engage an outer profile of the coupling member 135 of the biasable member 130. However, in other embodiments, the impactee 120 may additionally or alternatively include a grasping element configured to engage and inner profile of the biasable member 130. Thus, the detachable coupling of the impactee 120 and the biasable member 130 according to aspects of the present disclosure is not limited to the embodiment shown in FIG. 1.

The biasable member 130 and impactee 120 are configured to disengage in response to a tensile force applied to the impact jar 100 reaching a predetermined quantity. For example, the impact jar 100 may be coupled in an intermediate location in a working string in a wellbore, wherein the impactor 110 may be coupled to an upper portion of the working string and the impactee 120 may be coupled to a lower portion of the working string. Consequently, tension applied to the working string by a slickline, e-line, coiled tubing, snubbing and/or other tensioning device extending to the surface of the wellbore may also be applied to the impact jar 100. As the tension applied to the impact jar 100 increases, the impactor 110 will translate axially relative to the impactee 120. That is, the impactee 120 will remain substantially fixed in location relative to the wellbore because it is coupled to the underlying lodged portion of the working string. Because the biasable member 130 is engaged with the impactee 120 via the coupling member 135 and coupling fingers 127, the biasable member 130 will also remain substantially fixed in location relative to the wellbore. However, because the impactee 120 and the biasable member 130 are configured to axially translate or otherwise slide within the impactor 110, the impactor 110 is free to react to the applied tension by axially translating up the wellbore.

Consequently, the spring 160 will be compressed as the compression stop 117 and the remainder of the impactor 110 axially translates away from the impactee 120. Moreover, the translation of the impactor 110 relative to the impactee 120 will also bring the impactee stop 129 into closer proximity with the impact stop 150 of the impactor 110. As the applied tension further increases, the spring 160 becomes further compressed. However, when the applied tension increases to a predetermined tensile force, the biasable member 130 and the impactee 120 will disengage. Once disengaged, the biasable member 130 is free to react to the compression of the spring 160. Consequently, the biasable member 130 will be rapidly translated to its neutral position, such as the position shown in FIG. 1. Accordingly, the biasable member 130 will impact the impactor 110, thereby applying an impulse force against the impactor 110. The impulse force applied to the impactor 110 by the biasable member 130 may be translated as an impulse force applied to the impactee 120. That is, the impact stop 150 of the impactor 110 may impact the impactee stop 129 as a result of the impact of the biasable member 130 against the impactor 110. Furthermore, the impact of the impactee 120 may be translated as an impact force to the lower portion of the working string to which the impactee 120 is coupled.

Thus, the disengagement of the biasable member 130 from the impactee 120 at the predetermined tensile force applied to the impact jar 100 may cause an impact between the biasable member 130 and the impactor 110, which may cause and impact between the impactor 110 and the impactee 120, such that an impact or impulse force may be applied to the lodged equipment coupled to the impactee 120. The impact force applied to the lodged equipment may encourage the equipment to become dislodged. In some embodiments, the above-described operation of the impact jar 100 may be repeated to apply multiple impacts to the lodged equipment.

Additionally, or alternatively, impact or impulse forces applied by the impactee 120 to the lodged equipment may occur for reasons other than the impact between the biasable member 130 and the impactor 110. For example, as the tensile load applied to the impact jar increases, the impactor 110 will translate axially away from the lodged equipment. When the biasable member 130 and the impactee 120 disengage at the predetermined tension, the impactor 110 is free to travel axially up the well bore until the impact stop 150 of the impactor 110 contacts the impactee stop 129 of the impactee 120, if this has not already occurred. The tension in the slickline, e-line, coiled tubing, snubbing and/or other tensioning device may thus cause this impact very quickly, possibly before the biasable member 130 can axially travel towards its neutral position and impact the impactor 110. Consequently, the tension applied to the impactor 110 may cause a first impact between the impactor 110 and the impactee 120, before the biasable member 130 can impact the impactor 110 and possibly impart an earlier impulse to the impactor 110.

Accordingly, in one embodiment, the disengagement of the biasable member 130 and the impactee 120 may impart two separate impulses or impact forces upon the lodged equipment. It follows that, in some embodiments, the dimensions of the components of the impact jar 100 and the predetermined tension at which the biasable member 130 and the impactee 120 disengage may be configured such that one or both of these impulse forces are minimized or maximized, or occur separately or simultaneously, as possibly determined on an application-specific basis.

As mentioned above, the predetermined tensile force at which the biasable member 130 and the impactee 120 become disengaged to apply an impact or impulse force to the lodged equipment may be adjusted. For example, the impact jar 100 may also include an adjustor 170 configured to adjust the predetermined tensile force at which the biasable member 130 and the impactee 120 disengage. In one embodiment, the adjustor 170 is a threaded sleeve rotatably coupled to an interior surface of the impactor 110 and adjacent the compression stop 117. However, the adjustor 170 may also or alternatively include a hydraulic piston or other means for adjusting the predetermined tensile force. The compression stop 117 may be integral to or otherwise coupled to the adjustor 170. Accordingly, in contrast to being fixed to the impactor 110, as discussed above, the compression stop 117 may be fixed to the adjustor 170.

In one embodiment, the adjustor 170 is rotatable within the impactor 110, such that the threaded coupling between the adjustor 170 and the impactor 110 causes axial translation of the adjustor 170 relative to the impactor 110 in response to rotation of the adjustor 170 relative to the impactor 110. By rotating the adjustor 170 relative to the impactor 110, thereby axially translating the adjustor 170 relative to the impactor 110, the fixed end of the spring 160 resting against the compression stop 117 may be axially adjusted. Accordingly, the tensile force at which the biasable member 130 and the impactee 120 disengage may be adjusted.

Moreover, the adjustor 170 may be externally accessible. For example, the impactor 110 may include an adjustment window through which the adjustor 170 may be accessed, such that the adjustor 170 may be manually adjusted without disassembly of the impact jar 100. In one embodiment, the impact jar 100 or a component thereof may include an electromechanical or other type of device configured to rotate, translate or otherwise manipulate the adjustor 170. Consequently, the adjustment of the tensile force at which the biasable member 130 and the impactee 120 disengage may be adjusted remotely without retrieving the impact jar 100 from within the wellbore.

In addition, the impact jar 100 may be employed with e-line and slickline tools, coiled tubing and snubbing. As discussed above, slickline tools employ a simple wire to suspend a tool in its selected location, and are designed to require no electrical power from the surface to perform their designed function. In such applications, the impact jar 100 may be readily coupled to the slickline tools with little or no concern for providing electrical power and data signal continuity between the first and second down-hole tool connectors 140, 145. However, the impact jar 100 may permit fluid flow therethrough. For example, each of the impactor 110, the impactee 120 and the biasable member 130 may include one or more apertures 180 configured to deliver fluid flow received at the first down-hole tool connector 140 through the length of the impact jar 100 to the portion of a working string coupled to the second down-hole tool connector 145. In one embodiment, the apertures 180 may be coaxial, which may improve the flow of fluid therethrough. The apertures 180 may allow fluid in the wellbore to flow past or through the impact jar 100 (e.g., into the jar 100 at the first down-hole connector 140 and subsequently out of the jar 100 at the second down-hole connector 145).

In some embodiments, it may not be desirable to allow fluid flow into at least portions of the interior of the impact jar 100. For example, some applications may require electric wiring to pass through the impact jar 100. Thus, in some embodiments, the impact jar 100 may include standard, conventional or future developed fluid/air connectors for allowing electrical power/signal pass-through. As also discussed above, e-line tools employ a multi-functional wire to suspend a tool in a specific location in a well and to transmit power and/or data signals between the wellbore and the well surface. Accordingly, the apertures 180 discussed above may also be configured to allow such a multi-functional wire to be passed through the impact jar 100. The impact jar 100 may also include a coiled, flexible or extendable wire or other conductor to maintain electrical continuity between the first and second down-hole tool connectors 140, 145 when the impactee 120 and the biasable member 130 disengage. In one embodiment, the impact jar 100 includes standard, conventional or future-developed electrical connectors in each of the first and second down-hole tool connectors 140, 145 connected by one or more electrical wires extending through the apertures 180.

The impact jar 100 may have a substantially constant outer diameter along its length to encourage smooth translation of the jar 100 within the wellbore. For example, the outer diameter may be about 2¾" or about 3⅜" for open wellbores, or between about 1½" and about 1¾" for cased wellbores. In one embodiment, the outer diameter is about 1⁹⁄₁₆", which may be employed for applications in which both e-lines and slick-lines may be employed. In another embodiment, the outer diameter is about 1¹¹⁄₁₆". In general, while not limited by the present disclosure, the outer diameter of the impact jar 100 may range between about ¾" and about 4". Moreover, the impact jar 100 may be employed for both cased wellbore and open wellbore applications, or may be dedicated to one of these applications.

Figure 2A:
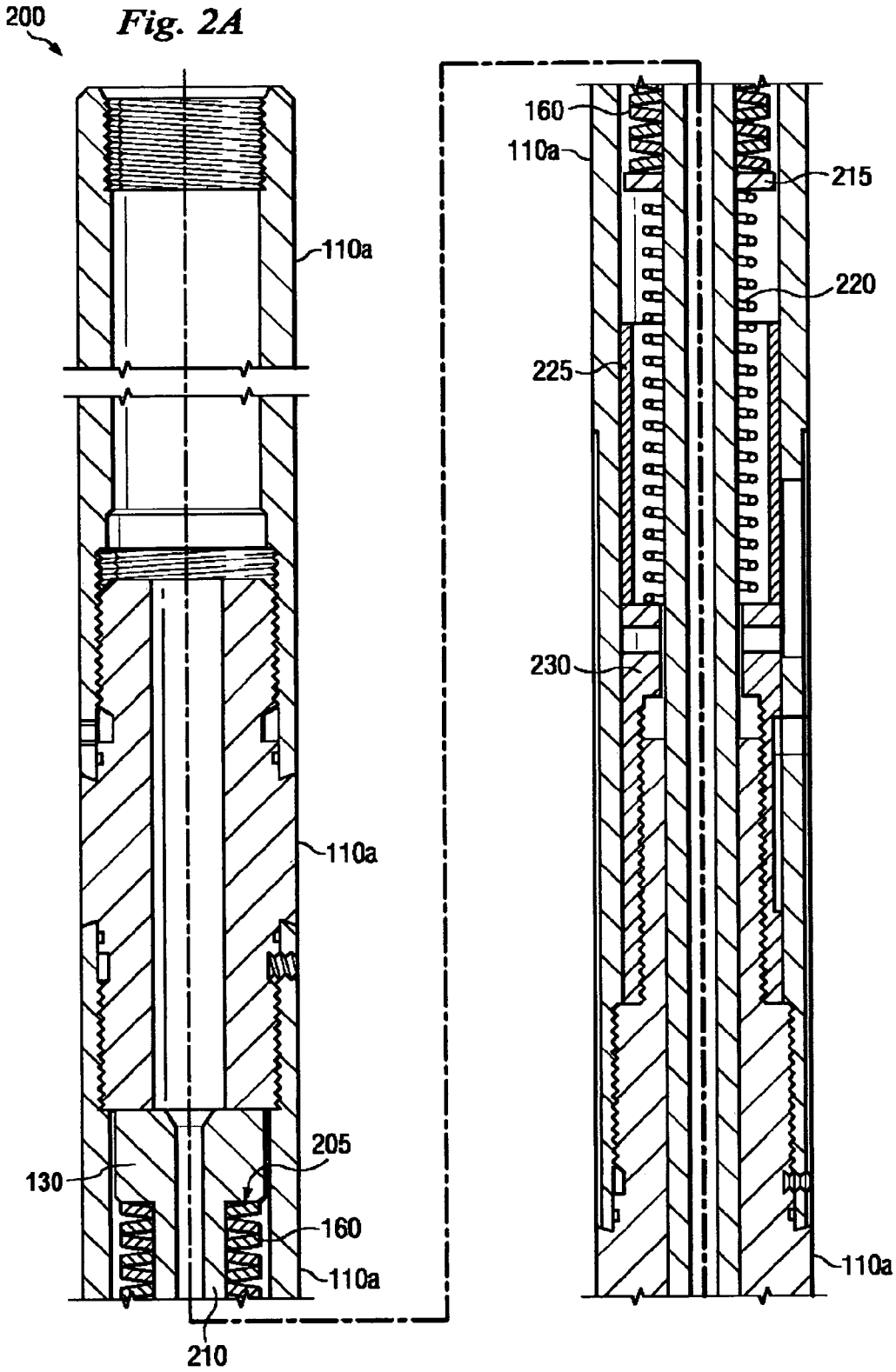
FIG. 2*a* illustrates a sectional view of a portion of another embodiment of an impact jar constructed according to aspects of the present disclosure.
Figure 2B:
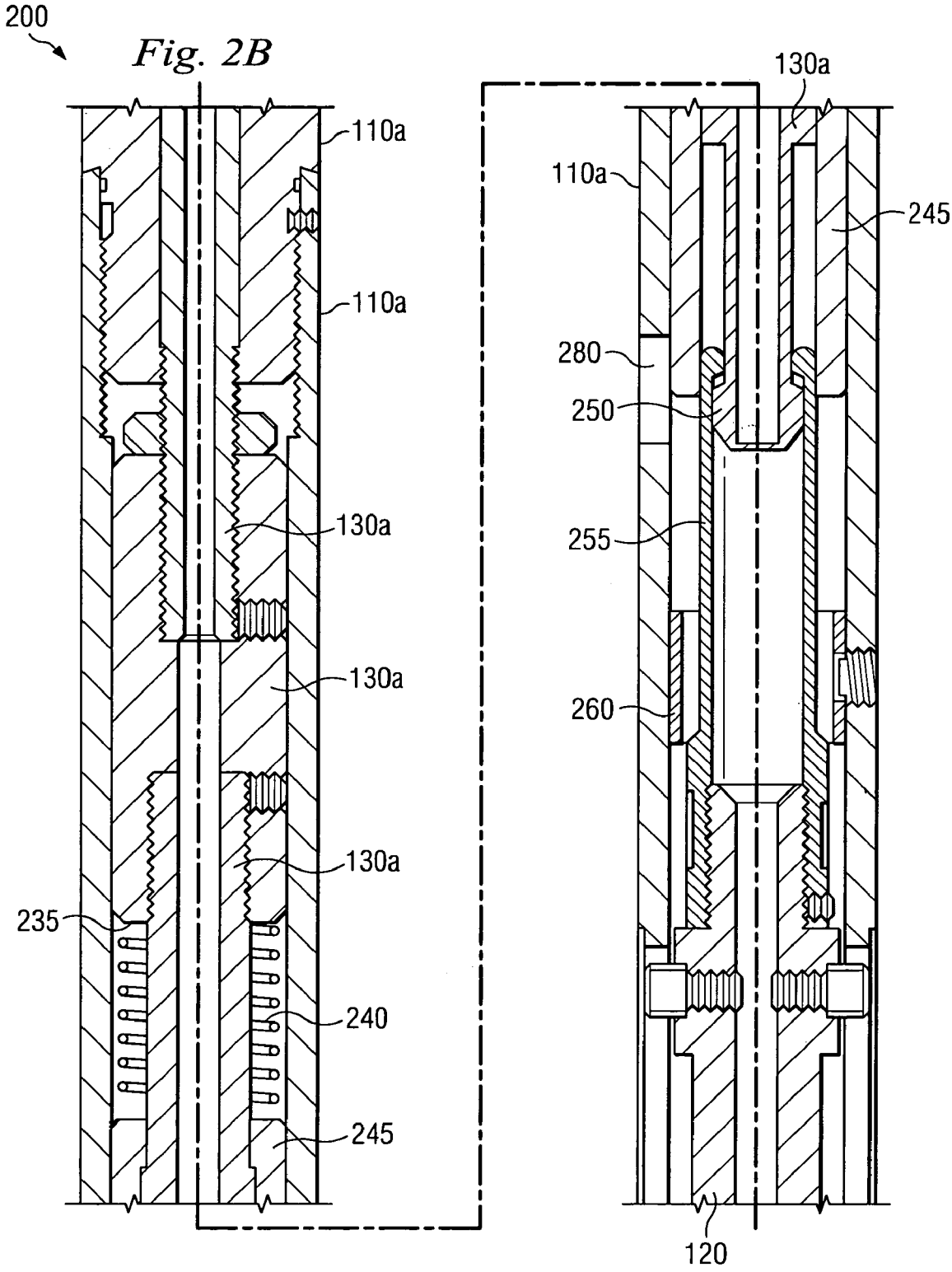
FIG. 2*b* illustrates a sectional view of a portion of another embodiment of an impact jar constructed according to aspects of the present disclosure.
Figure 2C:
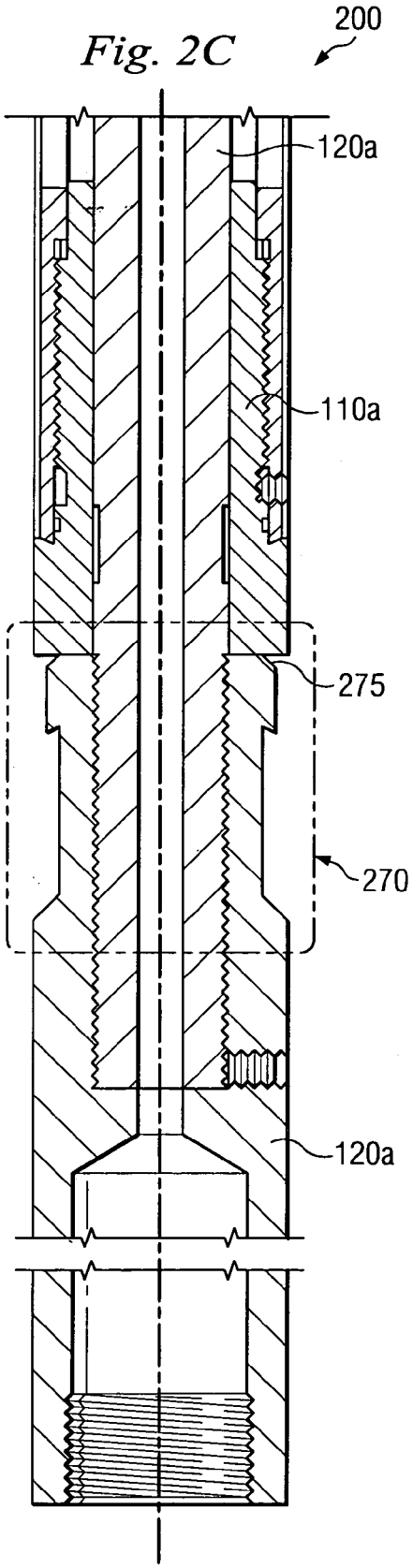
FIG. 2*c* illustrates a sectional view of a portion of another embodiment of an impact jar constructed according to aspects of the present disclosure.

Referring to FIGS. 2*a*–*c*, illustrated are sectional views of portions of at least one embodiment of an impact jar 200 constructed according to aspects of the present disclosure. Several embodiments of the impact jar 200 may be collectively illustrated in FIGS. 2*a*–2*c*. Moreover, each of the embodiments of the impact jar 200 that may be shown in FIGS. 2*a*–2*c* may be substantially similar to the impact jar 100 shown in FIG. 1. For example, the impact jar 200 shown in FIG. 2*a* includes an impactor 110, an impactee 120, a biasable member 130 and a spring 160 which may be substantially similar to those shown in FIG. 1, possibly excepting the description below. The impactor 110 shown in FIGS. 2*a*–2*c* may also include multiple portions 110*a* threaded, welded or otherwise coupled to one another.

As shown in FIG. 2*a*, the biasable member 130 includes an upper shoulder 205 against which a first end of the spring 160 rests. The biasable member 130 also includes a shaft 210 extending through the spring 160. The impact jar 200 includes an axially translatable washer, compression stop or other member (hereafter referred to as a washer) 215 against which a second end of the spring 160 may rest. The washer 215 may be biased against the second end of the spring 160 by a first positioning spring 220. The first positioning spring 220 is illustrated as a compression spring, although in other embodiments the first positioning spring 220 may be a tension or torsion spring, may comprise multiple springs, and may be another type of biasing member. The biasable member 130 may also extend through the first positioning spring 220.

The impact jar 200 also includes a first sleeve 225 axially translatable within at least one impactor portion 110*a* and through which the first positioning spring 220 and the biasable member 130 extends. The first sleeve 225 also rests on an adjustor 230 and is axially translatable within the impactor in response to rotation of the adjustor 230.

The adjustor 230 may be substantially similar to the adjustor 170 shown in FIG. 1. For example, the adjustor 230 may be externally accessible by hand or a tool for rotation, translation and/or other manipulation within the at least one of the impactor portions 110*a*. In the illustrated embodiment, the adjustor 230 axially translates within at least one impactor portion 110*a* in response to relative rotation between an impactor portion 110*a* and the adjustor 230, such as when the interface between the impactor portions 110*a* and the adjustor 230 is a threaded interface. The axial translation of the adjustor 230 also causes axial translation of the first sleeve 225. Consequently, the separation between the first sleeve 225 and the washer 215 may be adjusted by rotation of the adjustor 230, particularly if the spring constant of the first positioning spring 220 is less than the spring constant of the spring 160.

As shown in FIG. 2*b*, the biasable member 130 may include multiple portions 130*a* threaded, welded or otherwise coupled to one another. One of the portions 130*a* may include a lower shoulder 235 against which a first end of a second positioning spring 240 may rest. A second end of the second positioning spring 240 may rest against a second sleeve 245. The second sleeve 245 is axially translatable within at least one of the impactor portions 110*a*, and at least one of the biasable member portions 130*a* extends through the second sleeve 245.

In the embodiment shown in FIG. 2*b*, one of the biasable member portions 130*a* includes a male engagement member 250, the impactee 120 includes a female engagement member 255, and the impact jar 200 includes an actuating collar 260. The male engagement member 250 and the female engagement member 255 are configured to detachably engage. The collar 260 is welded or otherwise coupled to one of the impactor portions 110*a*. As described above with reference to FIG. 1, the impactor 110 is configured to axially translate relative to the impactee 120 in response to a tensile force applied to the impact jar 200. Because the collar 260 is rigidly coupled to one of the impactor portions 110*a*, the collar 260 axially translates relative to the impactee 120 as the impactor portions 110*a* axially translate relative to the impactee 120. As the collar 260 travels with the impactor portions 110*a* away from the impactee 120, the collar 260 will contact the second sleeve 245. The second sleeve 245 is configured to prevent the male and female engagement members 250, 255 from disengaging. Moreover, as the collar 260 continues to travel away from the impactee 120, the collar 260 will ease the second sleeve away from the junction of the male and female engagement members 250, 255. Consequently, the male and female engagement members 250, 255 may disengage, as described above. The impact jar 200 may also include an inspection window 280 through which an engagement status of the male and female engagement members 250, 255 is visibly noticeable. The inspection window 280 may also be configured to allow the insertion of a tool to manually disengage the male and female engagement members 250, 255, such that the impactor 110 and the impactee 120 may be manually translated in opposite directions, as specific applications may require.

FIG. 2*c* illustrates that the impactee 120 may comprise multiple impactee portions 120*a* welded, threaded or otherwise coupled to one another. FIG. 2*c* also reveals that one of the impactee portions 120*a* may include a fishing neck 270 having a standard fishing neck interface. In one embodiment, the impact jar 200 may be configured such that its weakest mechanical point is proximate or above the fishing neck 270. Consequently, if the impact jar 200 should mechanically fail while installed in a wellbore, the fracture point may be proximate the fishing neck 270 such that conventional down-hole fishing equipment may be employed to retrieve the portion of the impact jar 200 remaining in the wellbore. In one embodiment, the fishing neck 270 may include a beveled edge 275 to facilitate the alignment and capture of the fishing neck 270 by the fishing equipment.

Figure 3:
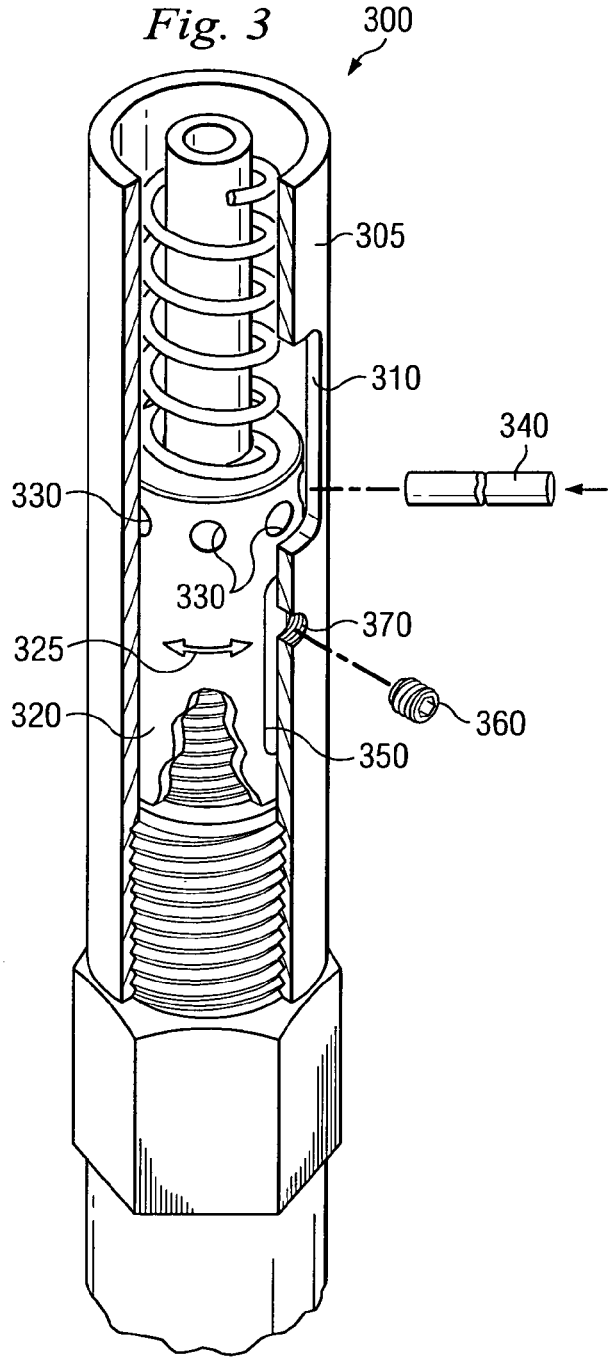
FIG. 3 illustrates a perspective view of a portion of another embodiment of an impact jar constructed according to aspects of the present disclosure.

Referring to FIG. 3, illustrated is a perspective view of a portion of another embodiment of an impact jar 300 constructed according to aspects of the present disclosure. The impact jar 300 may be substantially similar to the impact jar 100 of FIG. 1 and/or the impact jar 200 of FIGS. 2*a–c*.

In the embodiment shown in FIG. 3, the impact jar 300 includes an adjustment window 310 through which an adjustor 320 may be externally accessible. The adjustment window 310 may comprise an opening formed in an impactor portion 305. The adjustor 320 may include keyholes or other apertures (hereafter collectively referred to as apertures) 330 for receiving an adjustment tool 340. In the illustrated embodiment, the adjustor 320 includes 8 apertures 330, although the present disclosure does not limit the number of apertures 330 that may be formed in the adjustor 320. The adjustment tool 340 may be a screwdriver, allen wrench or other substantially cylindrical shaped member that may be employed to impart stepwise or other rotational movement to the adjustor 320, as indicated by the arrow 325.

The adjustor 320 and/or the impact jar 300 may also include means for preventing inadvertent rotation of the adjustor 320. For example, in the illustrated embodiment, the adjustor 320 includes a slot 350 in an exterior surface thereof and configured to receive a set screw or other obstructive member (hereafter collectively referred to as a set screw) 360. During operation of the impact jar 300, the set screw 360 may be tightened in a threaded aperture 370 in the impactor portion 305 such that the set screw 360 engages the adjustor slot 350. However, when the impact jar 300 requires adjustment, such as to adjust the tensile force at which the impact jar 300 imparts an impact or impulse force against a lodged portion of a working string, the set screw 360 may be backed off or otherwise disengaged from the slot 350. Consequently, the adjustor 320 may be rotated by manipulation with the adjustment tool 340 to adjust the tension set point of the impact jar 300, and the set screw 360 may once again be tightened or otherwise manipulated to re-engage the adjustor slot 350.

Impact jars constructed according to aspects of the present disclosure may, thus, be desirable over conventional mechanical jars in that, for example, the impact jar 300 is field adjustable. That is, the tensile load at which the jar is triggered may be adjusted by accessing the adjuster 320 without dismantling the jar 300. Moreover, this trigger set-point may also be adjusted without disassembling the jar 300 from the working/tool string. For example, the trigger set-point may be adjusted while the applied tensile load is between 0 pounds and the trigger set-point itself. In one contemplated application, the trigger set-point may be adjusted while the impact jar 300 is loaded only by the weight of the working/tool string coupled to the impact jar 300. For example, the weight of the working/tool string in such applications may be about 50 pounds. In general, the trigger set-point (or the "predetermined quantity") may range between about 100 pounds and about 8000 pounds in one embodiments. In another embodiment, the trigger set-point may range between about 150 pounds and about 1400 pounds.

By enabling such adjustment, the tension at which the impulse is created may be accurately controlled and is less susceptible to triggering at excessive tension levels. In contrast, conventional hydraulic jars may trigger at any tensile load greater than the trigger point, possibly 1000–2000 pounds greater than the trigger set-point, as the tension increases during the delay required for the hydraulic fluid to flow between chambers or across a piston. That is, impact jars constructed according to aspects of the present disclosure create an impulse in response to the applied tension reaching a predetermined quantity. In contrast, conventional hydraulic jars create an impulse in response to hydraulic fluid flow within the jar, thereby allowing the delayed impulse to occur when the applied tensile load has far exceeded the trigger point.

On a similar note, the impulse created by jars constructed according to aspects of the present application may trigger within about 5 seconds of the trigger point being reached. In fact, in most embodiments, the impulse may occur substantially instantaneously after the trigger set-point is reached. In general, the impulse may be created during a time period ranging between about 0.5 seconds and about 5 seconds after the trigger set-point is reached. In contrast, a conventional hydraulic jar may not generate an impulse until 15, 30, 60 or 120 seconds after the trigger set-point is reached, such that the applied tension may continue to rise before the impulse is created, and possibly causing damage to the jar or other portion of the working/tool string.

Figure 4:
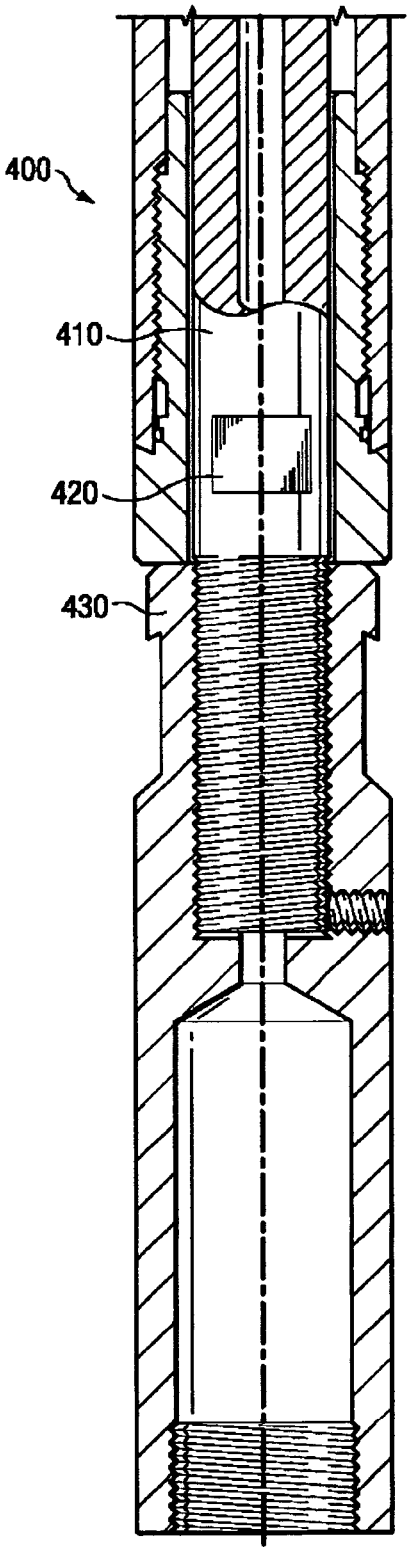
FIG. 4 illustrates a sectional view of a portion of another embodiment of an impact jar constructed according to aspects of the present disclosure.

Referring to FIG. 4, illustrated is a sectional view of a portion of an embodiment of an impact jar 400 constructed according to aspects of the present disclosure. Many of the components described above may have a substantially cylindrical outer profile. Generally, assembling a pair of threaded components that each have substantially cylindrical outer profiles can be challenging because the cylindrical surfaces of the components provide no flat surfaces that may be engaged with wrenches and other assembly tools. Consequently, assembling the cylindrical components to desired torque levels can be difficult, if not impossible.

However, the cylindrical components of impact jars constructed according to aspects of the present disclosure may include wrench flats proximate one or both ends of the components to facilitate assembly. For example, in the embodiment illustrated in FIG. 4, a first portion 410 of the impactee 120 may include one or more wrench flats 420 on an outer surface thereof. The wrench flats 420 may facilitate assembly of the first impactee portion 410 with a second impactee portion 430 by allowing additional torque to be applied to the impactee portions 410, 430 with a wrench or other assembly tool. Similar wrench flats may be employed on other components of the impact jar embodiments disclosed herein or their equivalents.

Figure 5A:
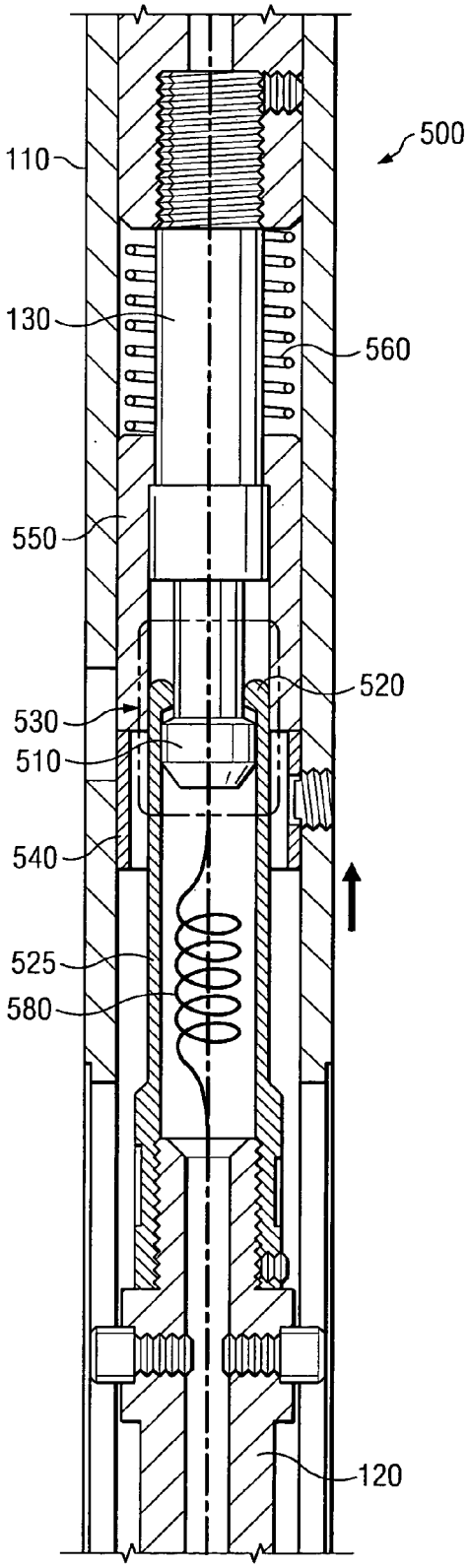
FIGS. 5*a*–5*d* illustrate sectional views of another embodiment of an impact jar during operation according to aspects of the present disclosure.
Figure 5B:
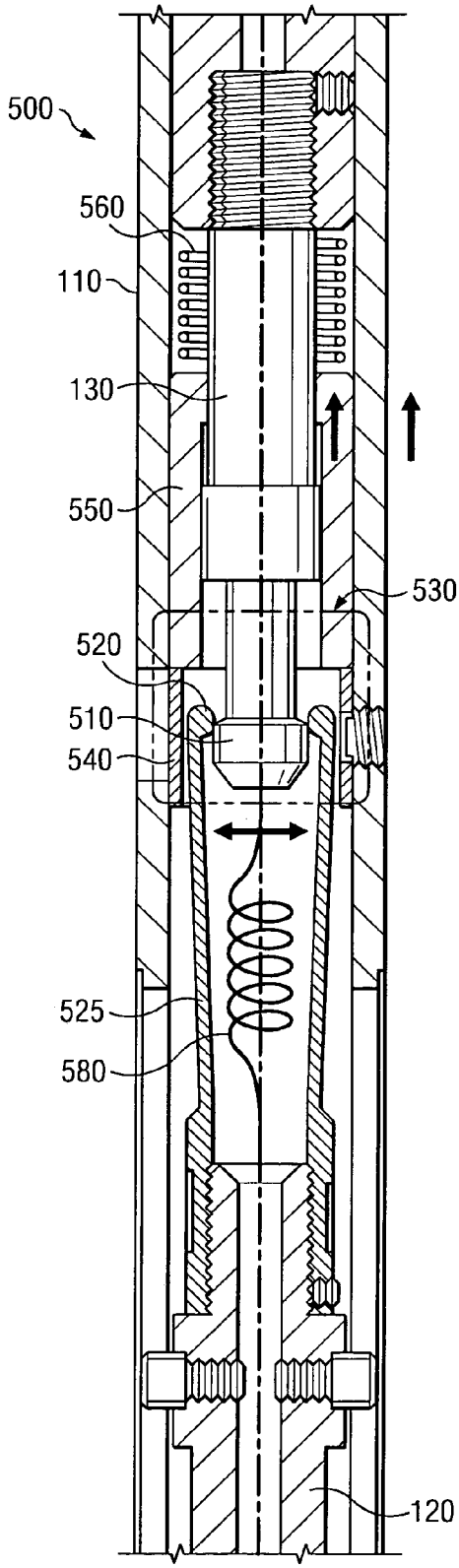
Figure 5C:
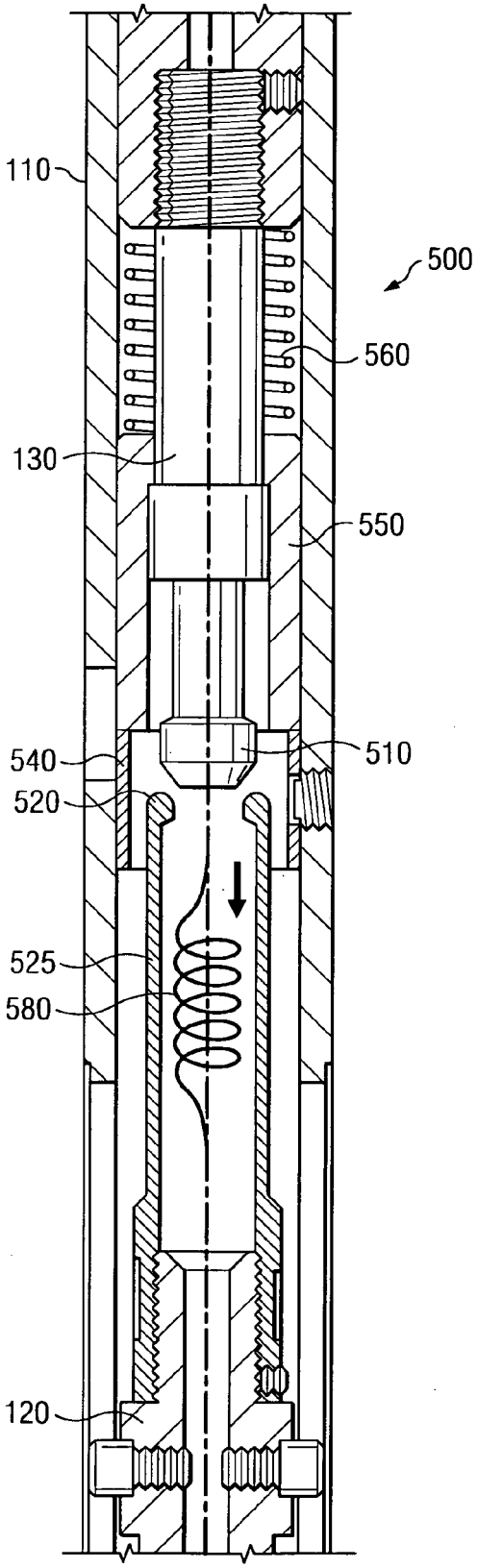

Referring to FIGS. 5*a–c*, illustrated are sectional views of a portion of one embodiment of an impact jar 500 during successive stages of operation according to aspects of the present disclosure. The impact jar 500 may be substantially similar to the impact jar 100 of FIG. 1 and/or the impact jar 200 of FIGS. 2*a–c*. For example, the impact jar 500 includes an impactor 110, an impactee 120 and a biasable member 130 which may be substantially similar to the corresponding components shown in FIGS. 1 and 2*a–c*. The biasable member 130 may include a male engagement member 510 and the impactee 120 may include a female engagement member 520 and detachably engaged with the male engagement member 510 at a junction 530.

The impact jar 500 shown in FIG. 5*a* is in an intermediate stage of operation in which a tensile force applied to the impact jar 500 is less than a predetermined trigger force. As previously discussed above, the impact jar 500 may include a collar 540 coupled to the impactor 110 and an engagement sleeve 550 configured to be axially translated relative to the engagement member junction 530. Under normal operating conditions, the engagement sleeve 550 will be biased into a position substantially encompassing the engagement member junction 530, such as by a positioning spring 560. However, as shown in FIG. 5*a*, as the tensile force applied to the impact jar 500 increases, the engagement sleeve 550 will be biased against the positioning spring 560 by the axial translation of the collar 540 and the impactor 110.

Referring to FIG. 5*b*, as the tensile force applied to the impact jar 500 increases to the predetermined trigger force, the engagement sleeve 550 may be axially translated away from the engagement member junction 530 a distance within the impactor 110 that is sufficient to allow the male and female engagement members 510, 520 to disengage. For example, the female engagement member 520 may include a plurality of flexible fingers 525 each having ends configured to engage an end of the male engagement member 510. The flexible fingers 525 may be prevented from deflecting away from the position shown in FIG. 5*a* when the engagement sleeve 550 circumscribes the fingers. However, when the engagement sleeve 550 is translated away from the junction 530, as shown in FIG. 5*b*, the flexible fingers 525 of the female engagement member 520 may deflect away from the male engagement member 510, thereby allowing the biasable member 130 to disengage and rapidly travel away from the impactee 120, as discussed above.

Once the male and female engagement members 510, 520 become disengaged, such that the impactor 110 and the biasable member 130 travel away from the impactee 120, the positioning spring 560 will bias the engagement sleeve 550 back towards a neutral position, as shown in FIG. 5*c*, such that the engagement sleeve 530 may once again encompass the male engagement member 510. It may be desirable at this point in the operation of the impact jar 500 to reset the jar 500 for successive operations. Accordingly, the tensile load applied to the impact jar 500 may be reduced, such that the impactor 110 and biasable member 130 may once again travel towards the impactee 120 under their own weight.

Figure 5D:
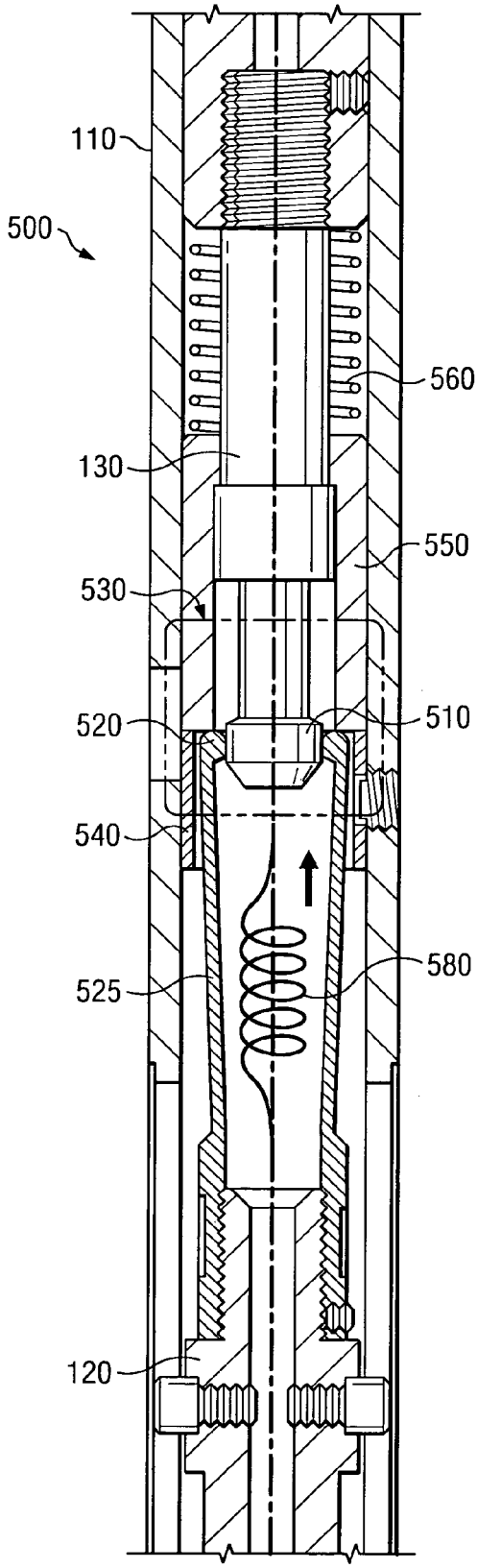

As shown in FIG. 5*d*, the flexible fingers 525 of the female engagement member 520 may cause the engagement sleeve 550 to axially translate away from the male engagement member 510 as the impactor 110 is brought closer to the impactee 120 during the resetting operation. Moreover, further translation of the impactee 120 towards the biasable member 130 will cause the flexible fingers 525 to contact the male engagement member 510 and deflect outwards. The interfacing profiles of the male and female engagement members 510, 520 are configured to encourage this deflection of the flexible fingers 525 of the female engagement member 520 such that the ends of the fingers 525 may continue to translate up and beyond the end of the male engagement member 510. Once the ends of the flexible fingers 525 of the female engagement member 520 travel a sufficient distance past the lower tip of the male engagement member 510, the ends of the flexible fingers 525 will re-engage the male engagement member 510.

At this point, the flexible fingers 525 of the female engagement member 520 are no longer deflected outward by the male engagement member 510, at least not to a degree sufficient to prevent the engagement sleeve 550 from axially translating back towards the impactee 120. Consequently, the positioning spring 560 may return the engagement sleeve 550 back over the junction 530 between the engaged male and female engagement members 510, 520, as shown in FIG. 5*a*. The impact jar 500 may then be actuated again by increasing the tensile load applied to the impact jar 500 to the predetermined tensile force.

FIGS. 5*a*–5*d* also illustrate that the impact jars constructed according to aspects of the present disclosure may include a flexible or coiled conductor 580 extending between the male and female engagement members 520, 525. The conductor 580 is flexible such that upon separation of the male and female engagement members 520, 525, electrical continuity may be maintained between the distal ends of the impact jar 500. As discussed above, some applications require that one or more power/data signals may be passed through the impact jar 500, such that in some embodiments the impact jar 500 may include fluid-to-air connectors in the down-hole tool connectors. Electrical conductors may, therefore, extend from the down-hole tool connectors of the impact jar 500 to the flexible conductor 580. Such electrical conductors extending through the impact jar 500, including the flexible conductor 580, may be single strand wiring or braided wiring. The conductors may also be insulated and/or shielded. The impact jar 500 may also include flexible conduit between the male and female engagement members 520, 525 to provide additional mechanical protection and/or electrical isolation of the flexible conductor 580. In other embodiments, the conductor 580 may be straight instead of coiled in the region between the engagement members 520, 525. That is, the re-engagement of the members 520,525 may pinch or severe the conductor 580 in some applications or configurations. Accordingly, in such embodiments, the coiled portion of the conductor 580 may be located in another region of the impact jar 500.

Figure 6:
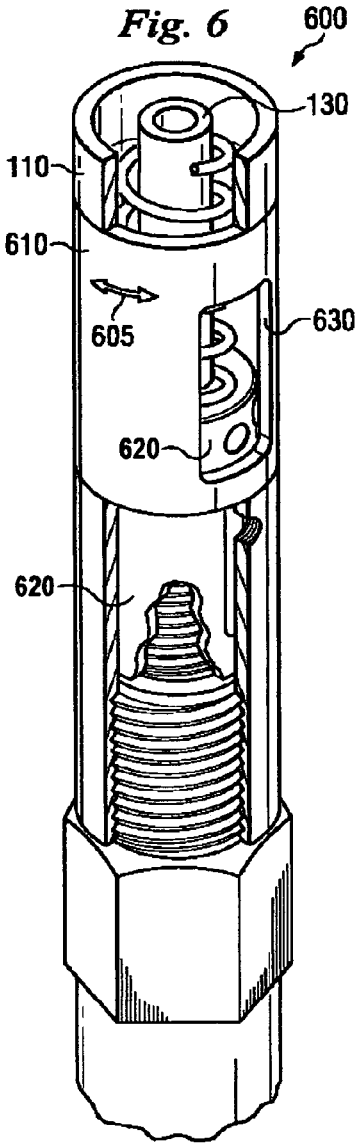
FIG. 6 illustrates a perspective view of a portion of another embodiment of an impact jar constructed according to aspects of the present disclosure.

Referring to FIG. 6, illustrated is a perspective view of a portion of an impact jar 600 constructed according to aspects of the present disclosure. The impact jar 600 may be substantially similar to the impact jar 100 of FIG. 1 and/or the impact jar 200 of FIGS. 2*a–c*. For example, the impact jar 600 includes an impactor 110 and a biasable member 130 which may be substantially similar to the corresponding components shown in FIGS. 1 and 2*a–c*.

In the embodiment shown in FIG. 6, the impact jar 600 includes an adjustment window cover 610 through which an adjustor 620 may be externally accessible. The adjustment window cover 610 may be or comprise a cover sleeve disposed concentrically around the impactor 110 and having a window 630 or other opening providing access to the adjustor 620. The adjustment window cover 610 may be rotatable with respect to the impactor 110, as shown by the arrow 605, such that the adjustment window cover 610 may require rotation to expose the adjustor 620 prior to rotation, translation or other manipulation of the adjustor 620.

In another embodiment, the adjustment window cover 610 may slide axially relative to the impactor to expose the adjustor 620. The adjustment window cover 610 may also rotate away from the impactor, possibly in a hinged configuration. The adjustment window cover 610 may also snap on and off of the impactor to selectively cover and expose the adjustor 620, or the adjustment window cover 610 may be coupled to the impactor 110 by threaded fasteners or other coupling means. Moreover, in some embodiments, the adjustment window cover 610 may be biased into a closed position, such as by a torsion, compression or tension spring, whereby upon releasing the adjustment window cover 610 after manipulating the adjuster 620, the adjustment window cover 610 returns to the closed position. In one embodiment, the adjustment window cover 610 and the impactor 110 may have identical or substantially similar outer diameters.

In embodiments incorporating the adjustment window cover 610, one or more portions of the impactor 110 may include apertures or other vents to accommodate the equalization of pressure differentials across the physical boundaries of the impact jar 600. For example, when the adjustment window cover 610 is not configured for accessing the adjustor 620, pressure differentials between the interior and exterior of the jar 600 may cause the cover to implode into the jar 600 if pressure differentials are not be able to sufficiently equalize.

Figure 7:
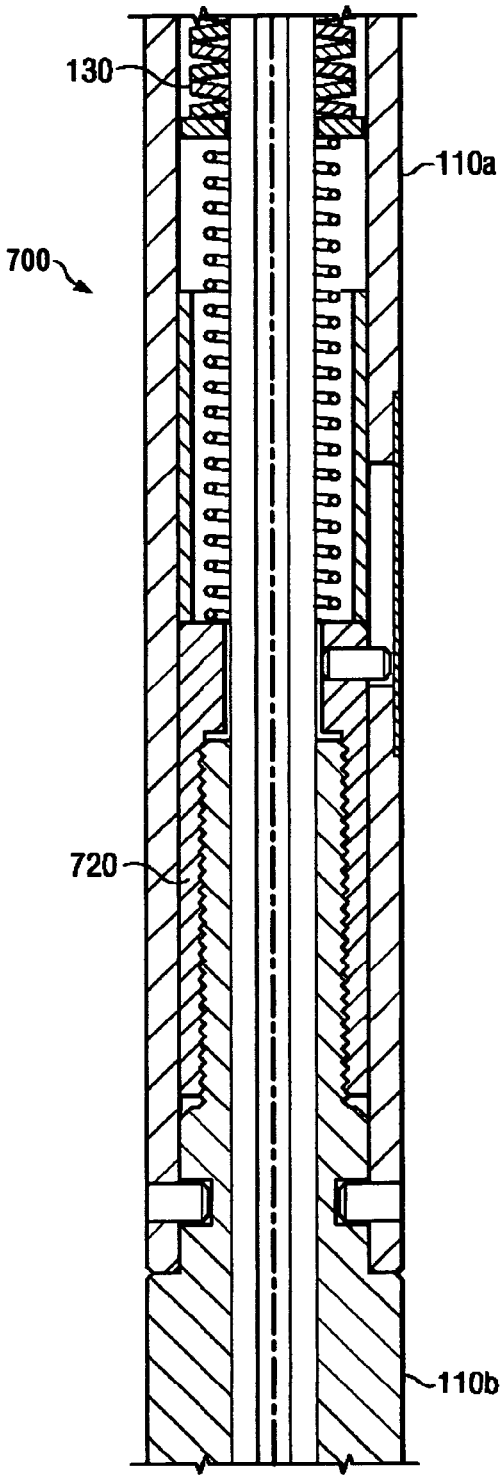
FIG. 7 illustrates a sectional view of a portion of another embodiment of an impact jar constructed according to aspects of the present disclosure.

Referring to FIG. 7, illustrated is a sectional view of a portion of another embodiment of an impact jar 700 constructed according to aspects of the present disclosure. The impact jar 700 may be substantially similar to the impact jar 100 of FIG. 1 and/or the impact jar 200 of FIGS. 2*a–c*. However, the impact jar 700 includes an externally accessible adjustor that is an alternative embodiment to the corresponding component in embodiments discussed above. The externally accessible adjustor shown in FIG. 7 may not require an adjustment window or other opening in the impactor 110 as in previously described embodiments. In contrast, the impactor 110 may be separated into two (or more) distinct portions that are rotatable relative to each other. For example, rotation of a first impactor portion 110*a* relative to a second impactor portion 110*b* may cause an internal adjustor 720 to axially translate within one of the impactor portions 110*a*, 110*b* to adjust the compression of the biasable member 130. The internal adjustor 720 may be rigidly coupled to or formed integral with one of the impactor portions 110*a*, 110*b*, and may be in threaded engagement with the other of the impactor portions 110*a*, 110*b*. Moreover, such relative rotation between the impactor portions 110*a*, 110*b* may be performed by hand, rather than requiring hand or machine tools, such as the adjustment tool 340 shown in FIG. 3.

In one embodiment, the impact jar 700 may include a locking or other safety mechanism to prevent inadvertent rotation of the impactor portions 110*a*, 10*b* relative to each other, thereby preventing inadvertent adjustment of the tensile force at which the impact jar 700 imparts an impact or impulse force against a lodged portion of a working string coupled thereto. Such a safety mechanism may include aligned apertures through both impactor portions 110*a*, 110*b* and configured to receive a common locking pin, such as a cottar pin or a ball-detent pin. The safety mechanism may also include a set screw or other threaded fastener, although such an embodiment may again require a tool for manipulation. The safety mechanism may also include one or more spring loaded buttons attached to one of the impactor portions 110*a*, 110*b* and extending through one or more openings in the other of the impactor portions 110*a*, 10*b*, such that the one or more buttons may be depressed to allow rotation of the impactor portions 110*a*, 110*b* relative to each other.

The rotation force required to rotate the impactor portions 110*a*, 110*b* relative to one another may also be provided by rotation means contained within the impactor portions 110*a*, 110*b*. For example, the impact jar 700 may include one or more servos or other electrical motors which may be coupled to the impactor portions 110*a*, 110*b* to cause relative rotation of the impactor portions 10*a*, 110*b*. The electrical motors may receive power from batteries also contained within the impactor portions 110*a*, 110*b* or from a power source at the surface of the wellbore. The operation of such an automated rotation mechanism may be local, such as through buttons or an operating panel on the exterior surface of one of the impactor portions 110*a*, 110*b*. However, the automated rotation mechanism may also be remotely controlled wirelessly or by an electrical conductor spanning the line suspending the impact jar 700 in the wellbore. Accordingly, the adjustable tensile force at which the impact jar 700 imparts an impact or impulse force on the lodged equipment coupled thereto may be adjusted without retrieving the impact jar 700 from within the wellbore.

Figure 8:
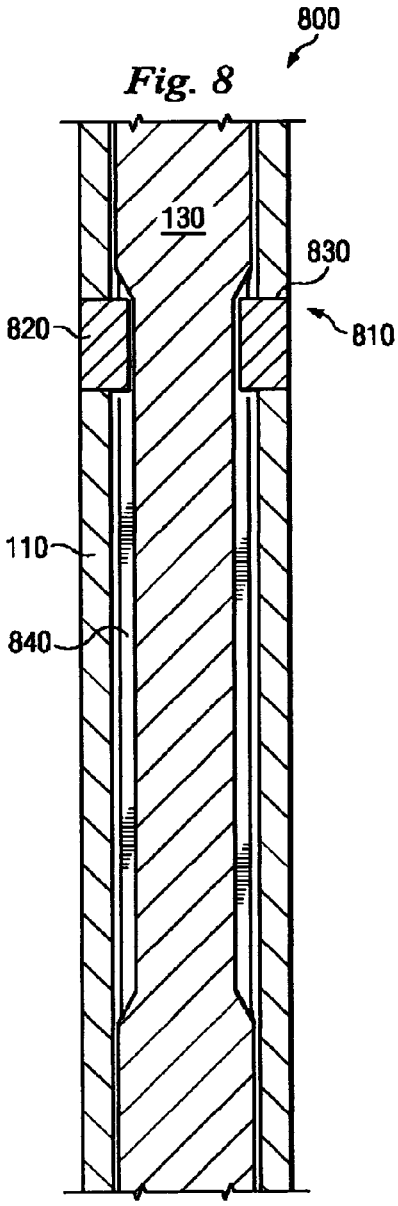
FIG. 8 illustrates a sectional view of a portion of another embodiment of an impact jar constructed according to aspects of the present disclosure.

Referring to FIG. 8, illustrated is a sectional view of a portion of another embodiment of an impact jar 800 constructed according to aspects of the present disclosure. The impact jar 800 may be substantially similar to the impact jar 100 of FIG. 1 and/or the impact jar 200 of FIGS. 2*a–c*. For example, the impact jar 800 includes an impactor 110 and a biasable member 130 which may be substantially similar to the corresponding components shown in FIGS. 1 and 2*a–c*.

Although not necessarily existing in every embodiment of an impact jar constructed according to aspects of the present disclosure, the impact jar 800 includes an anti-rotation mechanism 810 preventing relative rotation of the biasable member 130 and the impactor 110. In the illustrated embodiment, the anti-rotation mechanism 810 comprises one or more keys 820 retained in openings 830 in the impactor 110. The keys 820 are welded, adhered or otherwise coupled to the impactor 110 in the openings 830. In one embodiment, the keys 820 may be retained in the openings 830 by a friction fit or interference fit. The biasable member 130 also includes one or more keyways, slots or grooves (hereafter collectively referred to as keyways) 840 in the embodiment shown in FIG. 8. The keyways 840 are sized to receive the keys 820 when the keys 820 are retained in the openings 830. The keyways 840 are also substantially longer than the keys 820, such that the keys 820 may slide in the keyways 840 during relative translation between the biasable member 130 and the impactor 110. Consequently, relative rotation between the biasable member 130 and the impactor 110 may be prevented, or at least restricted to any difference in the widths of the keys 820 and the keyways 840. Moreover, although not illustrated in the present disclosure, relative rotation between the impactee 120 and the impactor 110 shown in previous embodiments may be prevented or restricted by a mechanism similar to the anti-rotation mechanism 810 shown in FIG. 8.

Figure 9:
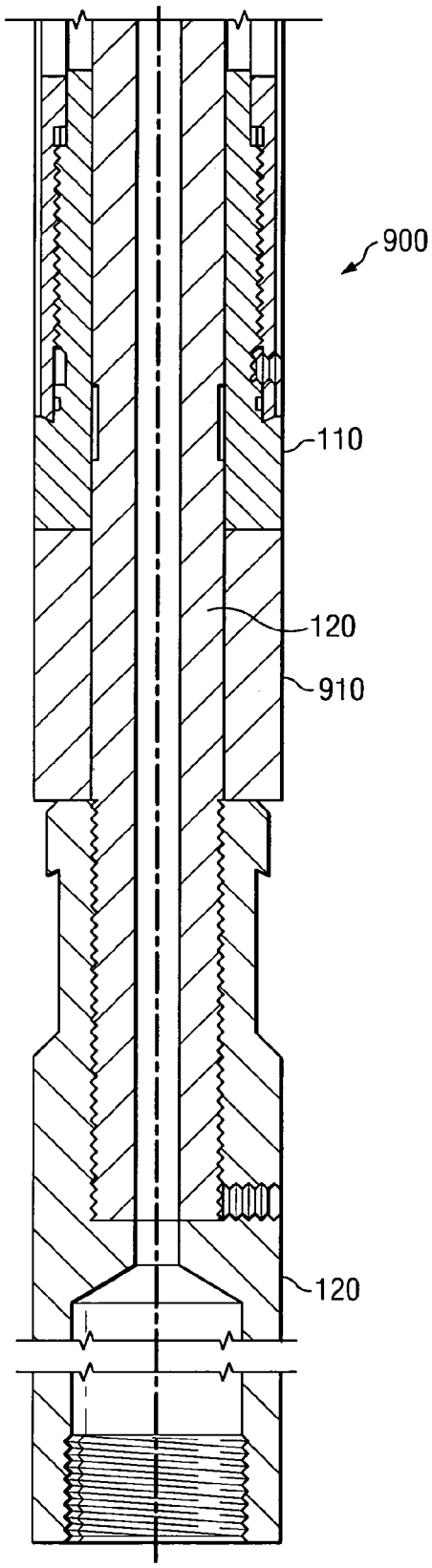
FIG. 9 illustrates a sectional view of a portion of one embodiment of an impact jar constructed according to aspects of the present disclosure.

Referring to FIG. 9, illustrated is a sectional view of a portion of another embodiment of an impact jar 900 constructed according to aspects of the present disclosure. The impact jar 900 may be substantially similar to the impact jar 100 of FIG. 1 and/or the impact jar 200 of FIGS. 2*a–c*. For example, the impact jar 900 includes an impactor 110 and an impactee 120 which may be substantially similar to the corresponding components shown in FIGS. 1 and 2*a–c*.

Although not necessarily existing in every embodiment of an impact jar constructed according to aspects of the present disclosure, the impact jar 900 also includes a locking clamp 910 couplable to at least one of the impactor 110 and the impactee 120 when the impactee 120 and the biasable member (130 in FIGS. 1 and 2*a–c*) are not engaged. The locking clamp 910 is installed prior to installing the impact jar 900 into a wellbore to prevent the inadvertent operation of the impact jar 900. For example, the locking clamp 910 may be configured to prevent the impactee 120 and the biasable member from becoming engaged. In one embodiment, an arming tensile load may be applied to the impact jar 900 such that the locking clamp 910 disengages the impact jar 900, whereby subsequently reducing the applied tension will allow the impactee 120 and the biasable member to engage and prepare for operation. In one embodiment, the arming tensile load may be substantially higher than the predetermined quantity or trigger set-point at which the impactee 120 and the biasable member are configured to disengage.

One embodiment of the locking clamp 910 may be a hinged, double C-clamp, having a latch configured to release and bias the halves of the locking clamp 910 open, thereby allowing the clamp 910 to fall from the impact jar 900. The locking clamp 910 may also be tethered, such that the clamp may be retrieved after becoming disengaged from the impact jar 900. Such a tether may also aid in or cause the disengagement of the locking clamp 910.

Figure 10:
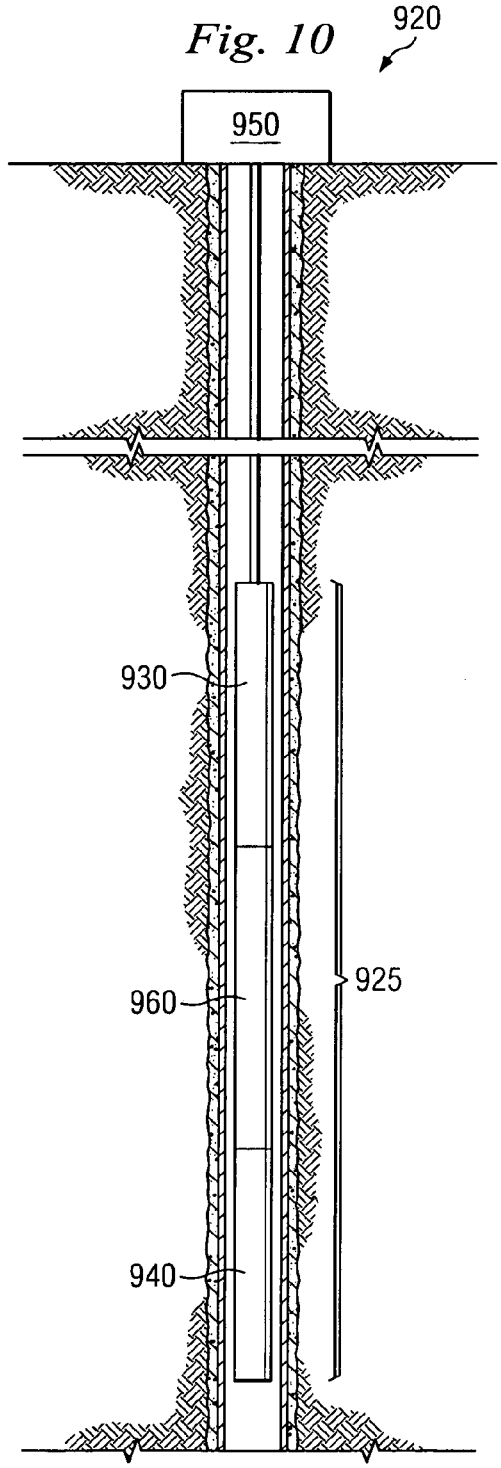
FIG. 10 illustrates a sectional view of one embodiment of a wellbore system constructed according to aspects of the present disclosure.

Referring to FIG. 10, illustrated is a sectional view of one embodiment of a wellbore system 920 constructed according to aspects of the present disclosure. The wellbore system 920 is one environment in which the several embodiments of impact jars described above may be implemented.

The wellbore system 920 includes a working string assembly 925 having a first portion 930 and a second portion 940. The wellbore system 920 also includes a tensioning device 950 configured to apply an adjustable tensile force to the working string assembly 925. Although schematically depicted in FIG. 10, those skilled in the art will recognize the tensioning device 950 as a crane, winch or other lifting device coupled to the working string assembly 925 by a slickline, e-line, coiled tubing, snubbing or other means.

The wellbore system 920 also includes an impact jar 960. The impact jar 960 may be substantially similar to one or more of the impact jars described above. The impact jar 960 may be employed to retrieve a portion of the working string assembly 925 lodged or rigidly secured within the wellbore. The impact jar 960 may be coupled to a portion of the working string assembly 925 before the working string assembly 925 is placed in the well-bore, such as in prophylactic applications, or after the working string assembly 925 is placed in the well-bore, such as in "fishing" applications.

Thus, the present disclosure provides an impact jar including a biasable member, an impactor and an impactee slidably coupled to the impactor. The impactor includes a first down-hole tool connector. The impactee includes a second down-hole tool connector distal from the first down-hole tool connector and a plurality of flexible coupling fingers. The biasable member is detachably engaged by the plurality of flexible coupling fingers in a pre-impact position and is configured to disengage the plurality of flexible coupling fingers in response to a tensile force applied across the first and second down-hole tool connectors reaching a predetermined quantity. The impactor and the impactee are configured to impact in response to the disengagement of the biasable member and the plurality of flexible coupling fingers. In one embodiment, the impact jar may be employed in either of e-line and slickline applications.

An impact jar for use in a cased well-bore is also introduced in the present disclosure. In one embodiment, the cased well-bore impact jar includes first and second opposing cased well-bore tool connectors, an impactor coupled to the first cased well-bore tool connector, and an impactee slidably coupled to the impactor. The impactor and the impactee are configured to impact when a tensile force applied across the first and second cased well-bore connectors reaches a predetermined quantity. The impact jar for use in a cased well-bore may also include a biasable member detachably engaged to the impactee in a pre-impact position and configured to disengage the impactee in response to the tensile force reaching the predetermined quantity, thereby allowing the impactor and impactee impact.

The present disclosure also introduces methods of dislodging down-hole equipment from a well-bore. One embodiment of such a method includes coupling an impact jar to the down-hole equipment, wherein the impact jar includes a biasable member, an impactor and an impactee slidably coupled to the impactor. The impactor is coupled to a tensioning device, and the impactee is coupled to the down-hole equipment. The biasable member is detachably engaged to the impactee in a pre-impact position and is configured to disengage the impactee in response to a tensile force applied by the tensioning device reaching a predetermined quantity. The impactor and impactee are configured to impact in response to the disengagement of the biasable member and the impactee. The method further includes operating the tensioning device to increase the tensile force towards the predetermined quantity. The tensile force is reduced after the biasable member and the impactee disengage.

The present disclosure also provides a wellbore system, including: (1) a working string assembly including first and second portions; (2) a tensioning device configured to apply an adjustable tensile force to the working string; and (3) an impact jar. In one embodiment, the impact jar includes a biasable member, an impactor and an impactee slidably coupled to the impactor. The impactor is coupled to the first working string assembly portion. The impactee is coupled to the second working string assembly portion and includes a plurality of flexible coupling fingers. The biasable member is detachably engaged to the plurality of flexible coupling fingers in a pre-impact position and is configured to disengage the plurality of flexible coupling fingers in response to a tensile force applied by the tensioning device reaching a predetermined quantity. The impactor and the impactee are configured to impact in response to the disengagement of the biasable member and the plurality of flexible coupling fingers.

The foregoing has outlined features of several embodiments so that those skilled in the art may better understand the detailed description that follows. Those skilled in the art should appreciate that they can readily use the present disclosure as a basis for designing or modifying other processes and structures for carrying out the same purposes and/or achieving the same advantages of the embodiments introduced herein. Although embodiments of the present disclosure have been described in detail, those skilled in the art should realize that such equivalent constructions do not depart from the spirit and scope of the present disclosure, and that they can make various changes, substitutions and alterations herein without departing from the spirit and scope of the present disclosure.

What is claimed is:

1. An impact jar, comprising:

an impactor having a first down-hole tool connector;

an impactee slidably coupled to the impactor, having a second down-hole tool connector distal from the first down-hole tool connector, and having a plurality of flexible coupling fingers positionally fixed relative to the second down-hole tool connector in an axial direction; and a biasable member detachably engaged by the plurality of flexible coupling fingers in a pre-impact position and configured to disengage the plurality of flexible coupling fingers in response to a tensile force applied across the first and second down-hole tool connectors reaching a predetermined quantity, wherein the impactor and impactee are configured to impact in response to the disengagement of the biasable member and the plurality of flexible coupling fingers.

2. The impact jar of claim 1 wherein the impactor includes a first aperture, the impactee includes a second aperture and the biasable member includes a third aperture, wherein the first, second and third apertures collectively form a continuous passage between the first and second down-hole tool connectors.

3. The impact jar of claim 1 wherein at least one of the first and second down-hole tool connectors are detachably couplable to a slick-line working string.

4. The impact jar of claim 1 wherein at least one of the first and second down-hole tool connectors are detachably couplable to an e-line working string.

5. The impact jar of claim 4 wherein at least one of the first and second down-hole tool connectors are also detachably couplable to a slick-line working string.

6. The impact jar of claim 1 wherein at least one of the first and second down-hole tool connectors are detachably couplable to a coiled tubing working string.

7. The impact jar of claim 1 wherein at least one of the first and second down-hole tool connectors are detachably couplable to a snubbing working string.

8. The impact jar of claim 1 wherein the impactee includes a standard fishing neck interface.

9. The impact jar of claim 8 wherein the fishing neck interface includes a beveled upstream edge.

10. The impact jar of claim 1 further comprising a latch and release sleeve slidably contained in the impactor, the latch and release sleeve restricting the disengagement of the plurality of flexible coupling fingers by the biasable member in the pre-impact position and configured to allow the disengagement in response to the tensile force reaching the predetermined quantity.

11. The impact jar of claim 1 further comprising an externally accessible adjustor configured to adjust the predetermined quantity.

12. The impact jar of claim 11 wherein the adjustor is configured to adjust the predetermined quantity without disassembly of the impact jar.

13. The impact jar of claim 11 wherein the adjustor is configured to adjust the predetermined quantity without disengaging either of the first and second down-hole tool connectors.

14. The impact jar of claim 11 wherein the adjustor is configured to adjust the predetermined quantity when the tensile force is between 0 pounds and the predetermined quantity.

15. The impact jar of claim 11 wherein the adjustor includes a threaded member axially translatable within the impactor in response to rotation relative to the impactor.

16. The impact jar of claim 15 wherein the impactor includes an adjustment window and the adjustor includes a tool interface configured to receive a tool through the adjustment window, whereby the adjustor is configurable in response to motion of the tool within the adjustment window.

17. The impact jar of claim 16 further comprising an adjustment window cover configured to selectively cover and expose the adjustment window.

18. The impact jar of claim 1 further comprising an inspection window through which an engagement status of the plurality of flexible coupling fingers and the biasable member is visibly noticeable.

19. The impact jar of claim 1 wherein the biasable member and the plurality of flexible coupling fingers are configured to re-engage in response to reduction of the applied tensile force.

20. The impact jar of claim 1 wherein the impact jar includes an anti-rotation mechanism configured to prevent relative rotation between the first and second down-hole tool connectors.

21. The impact jar of claim 20 wherein the anti-rotation mechanism includes an axial slot in the impactor configured to receive an anti-rotation member.

22. The impact jar of claim 1 wherein the impactor comprises at least two impactor portions couplable by threaded fasteners, wherein at least one of the at least two impactor portions includes a wrench flat proximate the threaded fasteners.

23. The impact jar of claim 1 further comprising a locking clamp couplable to at least one of the impactee and the impactor when the impactee and the biasable member are not engaged, the locking clamp further configured to prevent the impactee and the biasable member from becoming engaged.

24. The impact jar of claim 1 wherein the first and second down-hole tool connectors include at least one fluid/air connector.

25. The impact jar of claim 1 wherein a length of the impact jar is about 5 feet.

26. The impact jar of claim 1 wherein a weight of the impact jar is about 45 pounds.

27. The impact jar of claim 1 wherein a maximum outer diameter of the impact jar is selected from the group consisting of:

about 1½";
about 1 9/16";
about 1 11/16";
about 1¾";
about 1 13/16"; and
about 3⅜".

28. The impact jar of claim 1 wherein a maximum outer diameter of the impact jar is selected from the group consisting of:

about 1¼";
about 1⅜";
about 2";
about 2⅛";
about 2¼";
about 2¾";
about 3⅛";
about 3½";
about 3¾"; and
about 4".

29. The impact jar of claim 1 wherein the impactor, the impactee and the biasable member each comprise nitrided steel.

30. The impact jar of claim 1 wherein the predetermined quantity ranges between about 100 pounds and about 8000 pounds.

31. The impact jar of claim 1 wherein the predetermined quantity ranges between about 150 pounds and about 1400 pounds.

32. The impact jar of claim 1 wherein the biasable member and the plurality of flexible coupling fingers are configured to disengage within about 5 seconds of the tensile force reaching the predetermined quantity.

33. A wellbore system, comprising:

a working string assembly including first and second portions;

a tensioning device configured to apply an adjustable tensile force to the working string assembly; and an impact jar, including:

an impactor coupled to the first working string assembly portion;

an impactee coupled to the second working string assembly portion, slidably coupled to the impactor, and having a plurality of flexible coupling fingers positionally fixed relative to the second working string assembly portion in an axial direction; and a biasable member detachably engaged to the plurality of flexible coupling fingers in a pre-impact position and configured to disengage the plurality of flexible coupling fingers in response to a tensile force applied by the tensioning device reaching a predetermined quantity, wherein the impactor and impactee are configured to impact in response to the disengagement of the biasable member and the plurality of flexible coupling fingers.

34. The system of claim 33 wherein the tensioning device includes a slick-line working string.

35. The system of claim 33 wherein the tensioning device includes an e-line working string.

36. The system of claim 33 wherein the tensioning device includes a coiled tubing working string.

37. The system of claim 33 wherein the tensioning device includes a snubbing working string.

* * * * *